US005743814A

United States Patent [19]

Endo

[11] Patent Number: 5,743,814

[45] Date of Patent: Apr. 28, 1998

[54] SOLID GOLF BALL

[75] Inventor: Seiichiro Endo, Shirakawa, Japan

[73] Assignee: Sumitomo Rubber Industries, Ltd., Hyogo-ken, Japan

[21] Appl. No.: 630,213

[22] Filed: Apr. 11, 1996

[30] Foreign Application Priority Data

Apr. 11, 1995 [JP] Japan ..... 7-110149

[51] Int. Cl.[6] ..... A63B 37/06; A63B 37/12

[52] U.S. Cl. ..... 473/374; 473/377; 473/378; 473/373

[58] Field of Search ..... 473/351.1, 377, 473/374, 378, 373

[56] References Cited

U.S. PATENT DOCUMENTS 5,368,304 11/1994 Sullivan et al. ..... 473/377

*Primary Examiner*—George J. Marlo

*Attorney, Agent, or Firm*—Birch, Stewart, Kolasch & Birch, LLP

[57] ABSTRACT

The present invention provides a golf ball which has excellent shot feel and good controllability of approach shots, as well as good hit feel when putting. The golf ball comprises a core and a cover covering the core, wherein the cover has a Shore D hardness of 40 to 60, a compression deformation A, formed by applying a load of from 10 kg to 130 kg to the golf ball, is within the range of 2.3 to 3.5 mm, a compression deformation B, formed by applying a load of from 0.2 kg to 5 kg to the golf ball, is within the range of 0.26 to 0.40, and a ratio of compression deformation B to compression deformation A is within the range of 0.10 to 0.15.

3 Claims, 2 Drawing Sheets

SOLID GOLF BALL

FIELD OF THE INVENTION

The present invention relates to a golf ball. More particularly, the present invention relates to a golf ball which has excellent shot feel, good controllability on an approach shot, and a good hit feel when putting.

BACKGROUND OF THE INVENTION

Two piece solid golf balls, which have been much used by amateur golfers, provide great flight distance when hit by a driver, a No. 1 wood club, or an iron club. However, these golf balls exhibit poor controllability on an approach shot because of less spin, which also makes it difficult to stop the ball on the green. The two piece solid golf ball also has poor feel when putting.

To the contrary, thread wound golf balls, which have been much used by professional golfers, have excellent controllability on approach shots because of the amount of spin which can be applied to the ball. Also,the shots including putts are soft in feel. The thread wound golf balls, however, provide a shorter flight distance when hit by a driver or an iron club, than the two piece solid golf balls.

OBJECTS OF THE INVENTION

According to the present invention, the spin amount of a golf ball can be adjusted to a suitable range without causing a loss of flight distance. Also, the golf ball of the present invention has excellent shot feel, good controllability of approach shots and good putt feel.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus, are not limitative of the present invention, and wherein.

SUMMARY OF THE INVENTION

Figure 1:
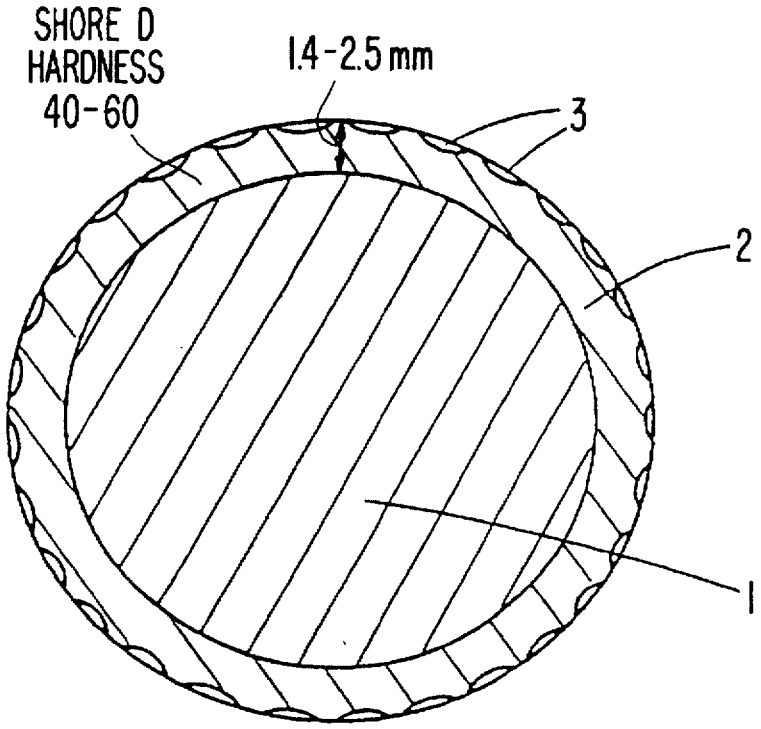
FIG. 1 is a schematic cross section illustrating one embodiment of the golf ball of the present invention.

The present invention provides a golf ball comprising a core and a cover covering the core, wherein

- a compression deformation A, formed by applying a load from 10 kg to 130 kg to the golf ball, is within the range of 2.3 to 3.5 mm,
- a compression deformation B, formed by applying a load from 0.2 kg to 5 kg to the golf ball, is within the range of 0.26 to 0.40 mm, and
- a ratio of compression deformation B to compression deformation A is within the range of 0.10 to 0.15.

DETAILED DESCRIPTION OF THE INVENTION

The compression deformation A is the difference of the deformation of a golf ball between an initial load of 10 Kg applying the golf ball and a final load of 130 Kg applying the golf ball. The compression deformation indicates ball characteristics when a large impact is applied to the golf ball. In the present invention, the compression deformation A should be within the range of 2.3 to 3.5 mm. The deformation A of less than 2.3 mm lowers controllability on approach shots and makes the shot feel by the driver poor, because the resulting golf ball is too hard. A deformation A of more than 3.5 mm makes the golf ball too soft, resulting in a deterioration in the rebound performance and a resulting shorter flight distance.

The compression deformation B is the difference in the deformation of a golf ball between an initial load of 0.2 Kg applied to the golf ball and a final load of 5 Kg applied to the golf ball. The compression deformation B indicates ball characteristics when a small impact is applied to the golf ball. In the present invention, the compression deformation B should be within the range of 0.26 to 0.40 mm. A deformation B of less than 0.26 mm lowers controllability on approach shot and creates a poor putting feel, because the resulting golf ball is too hard. A deformation B of more than 4.0 mm enhances the spin amount too much and reduces the flight distance when hit by a driver.

In the present invention, the ratio of deformation B to deformation A, i.e. deformation B/deformation A, should be controlled to a range of 0.10 to 0.15. When the ratio of B/A of less than 0.10 is brought about by a small amount of the deformation B, controllability of the golf ball on an approach shot is poor and the putt feel is poor. When the ratio of B/A of less than 0.10 is brought about by a large amount of deformation A, the resulting golf ball is too hard and has a poor shot fee. When the ratio of B/A of more than 0.15 is brought about by a large amount of the deformation B, the golf ball has too much spin and has a poor flight distance. When the ratio of B/A of more than 0.15 is brought about by a small amount of deformation A, controllability of the golf ball on an approach shot is poor.

As mentioned above, the adjustment of the deformation A range, the deformation B range and the ratio of B/A makes the amount of spin on the golf ball fall within a suitable range without a deterioration in flight distance, resulting in excellent controllability of approach shots, good shot feel and excellent putt feel. If the above parameters are outside the above ranges, the golf ball does not have sufficient characteristics.

The core used for the golf ball of the present invention is not limited as long as the above mentioned deformation ranges are satisfied. The core may be a solid core or a thread wound core. The solid core may be integrally uniform vulcanized rubber for a two piece solid golf ball or be composed of a two or more layer construction for a multi-piece solid golf ball. The core can also comprises a vulcanized rubber center and a thermoplastic resin layer formed thereon.

As an example, a core for a two piece solid golf ball is explained. The core is made from a rubber composition which comprises 100 parts by weight of polybutadiene rubber, 10 to 60 parts by weight of a vulcanizing agent (crosslinking agent), 10 to 30 parts by weight of a filler and 0.5 to 5 parts by weight of a peroxide and optionally 0.1 to 1 part by weight of an antioxidant. Examples of the vulcanizing agents are an α,β-ethylenically unsaturated carboxylic acid, such as acrylic acid and methacrylic acid; a metal salt thereof, such as zinc salt and has a magnesium salt; and a functional monomer, such as trimethylolpropane trimethacrylate. Examples of the fillers are zinc oxide, barium sulfate and the like. The rubber composition is prepared by mixing the above components and press-vulcanizing or curing them in a spherical mold at a temperature of 135° to 170° C. for 10 to 50 minutes to form the core. The vulcanization can be conducted in one step or two or more steps.

The cover for the golf ball of the present invention is not limited as long as the above mentioned deformation ranges are satisfied. The cover can be a resin type cover, for example an ionomer resin, or a balata type cover, for example balata. The cover may be an integrally uniform layer or composed of two or more layers. The cover preferably has a Shore D hardness of 40 to 60, more preferably 45 to 60. When the cover has a Shore hardness of less than 40, the cover is too soft and produces poor flight distance when hit by a driver. When the cover has a Shore D hardness of more than 60, the cover is too hard and produces poor controllability on approach shot and poor shot feel. The cover preferably has a thickness of 1.4 to 2.5 mm, more preferably 1.5 to 2.4 mm.

One representative example of a golf ball of the present invention is explained with reference to the drawing.

Figure 2:
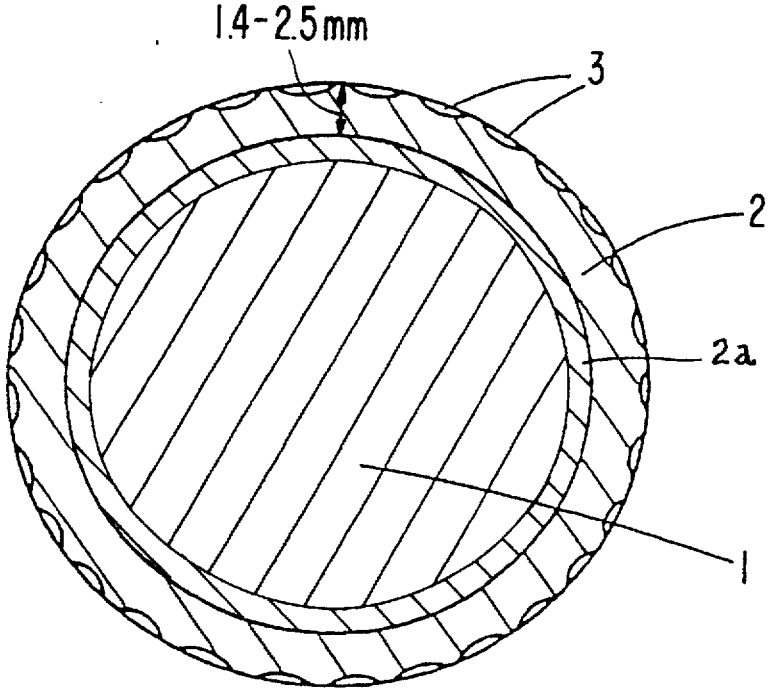
FIG. 2 is a schematic cross section illustrating an embodiment of the inventive golf ball with a multi-layer cover.

FIG. 1 is a schematic cross section of one embodiment of the golf ball of the present invention. The golf ball is composed of a core 1 which is a vulcanized molded article of rubber composition and a cover 2 covering the core 1. The core 1 is made of a uniform vulcanized rubber, but may be a two layer structure of an inner core formed by vulcanizing rubber composition using polybutadiene as the main rubber component and the outer core surrounding the inner core is formed by vulcanizing a rubber composition using polybutadiene as the main rubber component. The core 1 may also be a thread wound core comprising a liquid or rubber center and a thread rubber layer formed around the center. The cover 2 is drawn as a uniform layer, but may be two or more layers. The cover preferably has a Shore D hardness of 40 to 60, more preferably 45 to 60. If the cover has a two or more layer structure, the outermost cover preferably has a thickness of 1.4 to 2.5 mm, more preferably 1.5 to 2.4 mm. In FIG. 2, the multi-layer cover has an outermost layer and an inner layer 2*a*.

The number 3 in FIG. 1 shows dimples which are provided on the cover 2 with a suitable number and suitable arrangement to obtain a desirable performance. The golf ball may be painted on the surface or marked, if necessary.

EXAMPLES

The following Examples and Comparative Examples further illustrate the present invention in detail but are not to be construed to limit the scope thereof.

Examples 1 to 4 and Comparative Examples 1 to 4

A rubber composition for core was prepared according to the formulation shown in Table 1. The resulting composition was charged in a mold for core and vulcanized in the vulcanizing condition shown in Table 1 to form cores A–E. A diameter of the core was 39.0 mm and 37.9 mm for changing the cover thickness 1.85 mm and 2.40 mm. The units of the amount of the respective components described in Table 1 are parts by weight.

TABLE 1

| | A | B | C | D | E |
|---|---|---|---|---|---|
| BR-1 | 100 | 100 | 100 | 100 | 100 |
| Zinc acrylate | 31 | 25 | 20 | 36 | 20 |

TABLE 1-continued

| | A | B | C | D | E |
|---|---|---|---|---|---|
| *1 zinc oxide | 20 | 23 | 25 | 19 | 26 |
| Antioxidant | 0.6 | 0.6 | 0.6 | 0.6 | 0.6 |
| *2 Dicumyl peroxide | 1.3 | 1.7 | 2.1 | 0.9 | 2.1 |
| Vulcanizing condition (°C. × minutes) | 145 × 40 | 160 × 30 | 165 × 30 | 145 × 40 | 165 × 30 |
| | 170 × 10 | | | 170 × 10 | |

*1: Trade name, high-cis butadiene, manufactured by Japan Synthetic Rubber Co., Ltd.
*2: Yoshinox 425 (trade name), manufactured by Yoshitomi Seiyaku Co., Ltd.

Then, cover compositions a and b were prepared according to the formulation shown in Table 2. The units of the amounts show in Table 2 are parts by weight. The Shore D hardness of the resulting cover compositions is shown in Table 2. The Shore D hardness was determined according to ASTM D-2240 using a resin sheet having a thickness of about 2 mm formed by thermally pressing the cover composition, followed by storing two weeks at 23° C.

TABLE 2

| | a | b |
|---|---|---|
| Formulation: | | |
| Hi-milan 1605 *3 | 50 | 0 |
| Hi-milan 1706 *4 | 50 | 20 |
| Hi-milan 1855 *5 | 0 | 80 |
| Titanium dioxide | 2 | 2 |
| Shore D hardness | 68 | 57 |

*3: Hi-milan 1605 (trade name): ethylene-methacrylic acid copolymer ionomer resin obtained by neutralizing with sodium ion, manufactured by Mitsui Du Pont Polychemical Co., stiffness modulus: about 3,800 kg/cm$^2$, Shore D-scale hardness: 62
*4: Hi-milan 1706 (trade name): ethylene-methacrylic acid copolymer ionomer resin obtained by neutralizing with zinc ion, manufactured by Mitsui Du Pont Polychemical Co., stiffness modulus: about 3,400 kg/cm$^2$, Shore D-scale hardness: 61
*5: Hi-milan 1855 (trade name): ethylene-methacrylic acid-acrylate terpolymer ionomer resin obtained by neutralizing with zinc ion, manufactured by Mitsui Du Pont Polychemical Co., stiffness modulus: about 900 kg/km$^2$, Shore D-scale hardness: 55

The cover composition a and b obtained above were directly injection molded on the cores A–E to form a golf ball having a diameter of 42.7 mm and a ball weight of 45.3 g.

The compression deformation A, compression deformation B, flight distance (carry) when hit by a driver, controllability when hit by a driver, flight distance (carry) when hit by a No. 5 iron, spin amount by a wedge, shot feel on an approach shot, controllability on an approach shot, run on an approach shot and putt feel were evaluated. The evaluation method of the above ball characteristics is as follows.

Flight Distance When Shot by a Driver

A No. 1 wood club is mounted to a Swing robot manufactured by True Temper Co., and then a golf ball is hit at a head speed of 45 m/second to measure a distance to the dropping point.

Controllability When Shot by a Driver 10 top professional golfers hit a ball by a driver and evaluated whether or not they could hit the golf ball in the desired trajectory, shot feel, and distance based on an image in their mind. Evaluation criteria are shown as follow. In Table, the same criteria are indicated, but they show that more than 8 golfers among 10 golfers evaluated the same.

Evaluation Criteria

○: The ball is controllable and the golfers hit the ball as imagined in their mind.

Δ: The ball is slightly difficult to control.

X: The ball is difficult to control.

Flight Distance When Shot by a No. 5 Iron

A No. 5 iron club is mounted to a Swing robot manufactured by True Temper Co., and then a golf ball is hit at a head speed of 38 m/second to measure a distance to the dropping point.

Spin Amount When Shot by a Pitting Wedge

A pitting wedge is mounted to a Swing robot manufactured by True Temper Co., and then a golf ball is hit with a head speed of 33 m/second. The photograph of the hit golf ball is continuously taken to determine the spin amount.

Controllability When Shot by a Pitting Wedge 10 top professional golfers hit a ball toward the green by a pitting wedge and evaluate. Evaluation criteria are shown as follows. In Table, the same criteria are indicated, but they show that more than 8 golfers among 10 golfers evaluated the same.

Evaluation Criteria

○: It is felt that the ball is placed on a face of the pitting wedge and easily put a spin. The ball is stop on the green and has good controllability.

X: It is not felt that the ball is placed on a face of the pitting wedge. The ball is felt slip on the wedge and it is difficult to put spin on the ball. The ball is difficult to stop on the green and has poor controllability.

Shot Feel on an Approach Shot

It is evaluated by hitting a golf ball with a pitting wedge due to 10 top professional golfers. The evaluation criteria are as follows. The results shown in the tables below are based on the fact that not less than 8 out of 10 professional golfers evaluated with the same criterion about each test item.

Evaluation Criteria

○: Soft and excellent

Δ: Slightly hard

X: Hard and poor

Run at Approach Shot

When the ball was hit by a sand wedge from a point 20 yard apart from an edge of the green, there was a run on the green. The distance of the run was measured.

Putt Feel

It is evaluated by hitting a golf ball with a putter on the green by 10 top professional golfers. The evaluation criteria are as follows. The results shown in the Tables below are based on the fact that not less than 8 out of 10 professional golfers evaluated with the same criterion about each test item.

Evaluation Criteria

○: Soft and excellent

Δ: Slightly hard

X: Hard and poor

The results of the above evaluation are shown in Table 3 for Examples and Table 4 for Comparative Examples. Tables 3 and 4 also show used core and cover in the form of sign. Table 3 and 4 further show the ratio of deformation B/deformation A and cover thickness.

TABLE 3

| | Example 1 | Example 2 | Example 3 | Example 4 |
|---|---|---|---|---|
| Core | A | B | C | D |
| Cover | b | b | b | b |
| Compression deformation (A) (mm) | 2.60 | 3.05 | 3.40 | 2.35 |
| Compression deformation (B) (mm) | 0.295 | 0.320 | 0.345 | 0.320 |
| (B)/(A) | 0.1135 | 0.1049 | 0.1015 | 0.1362 |
| Cover thickness | 1.85 | 1.85 | 1.85 | 2.40 |
| Driver shot | | | | |
| Flight distance (yard) | 232 | 231 | 230 | 233 |
| Controllability | ○ | ○ | ○ | ○ |
| No. 5 iron shot | | | | |
| Flight distance (yard) | 190 | 191 | 192 | 189 |
| Spin amount by Pitting wedge (rpm) | 9000 | 8900 | 8850 | 9150 |
| Approach shot | | | | |
| Controllability | ○ | ○ | ○ | ○ |
| Shot feeling | ○ | ○ | ○ | ○ |
| Run (cm) | 85 | 95 | 95 | 80 |
| Putt feeling | ○ | ○ | ○ | ○ |

TABLE 4

| | Example 1 | Example 2 | Example 3 | Example 4 |
|---|---|---|---|---|
| Core | A | C | E | D |
| Cover | a | a | b | a |
| Compression deformation (A) (mm) | 2.40 | 2.95 | 3.65 | 2.10 |
| Compression deformation (B) (mm) | 0.230 | 0.245 | 0.370 | 0.220 |
| (B)/ (A) | 0.0958 | 0.0831 | 0.1014 | 0.1048 |
| Cover thickness | 1.85 | 1.85 | 2.40 | 2.40 |
| Driver shot | | | | |
| Flight distance (yard) | 233 | 232 | 228 | 229 |
| Controllability | x | x | ○ | x |
| No. 5 iron shot | | | | |
| Flight distance (yard) | 191 | 192 | 187 | 188 |
| Spin amount by Pitting wedge (rpm) | 7800 | 7650 | 9250 | 7600 |
| Approach shot | | | | |
| Controllability | x | x | ○ | x |
| Shot feeling | x | x | ○ | x |
| Run (cm) | 205 | 220 | 85 | 240 |
| Putt feeling | x | x | ○ | x |

It is clearly understood from the comparison between Examples 1–4 and Comparative Examples 1–4 that the golf ball which satisfied the criteria of the present invention has excellent flight distance, good controllability of approach shots, good shot feel and good putt feel.

On the other hand, the golf ball of Comparative Example 1 having a compression deformation B of less than 0.26 mm and a ratio of B/A of less than 0.10 showed long flight distance, but poor controllability and poor shot feel. The golf ball of Comparative Example 2 showed a similar tendency to Comparative Example 1. The golf ball of Comparative Example 3 has too large of a compression deformation A and therefore showed poor flight distance. The golf ball of Comparative Example 4 had a compression deformation A of less than 2.3 mm and a compression deformation B of less than 0.26 mm and therefore showed poor controllability and poor shot feel The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf ball comprising a core and a cover covering the core, said cover having a Shore D hardness of 40 to 60, wherein a compression deformation A, formed by applying a load of from 10 kg to 130 kg to the golf ball, is within the range of 2.3 to 3.5 mm, a compression deformation B, formed by applying a load of from 0.2 kg to 5 kg to the golf ball, is within the range of 0.26 to 0.40 mm, and a ratio of compression deformation B to compression deformation A (B/A) is within the range of 0.10 to 0.15.

2. The golf ball according to claim 1, wherein the cover has a multi-layer construction.

3. The golf ball according to claim 2, wherein the outermost cover layer has a thickness within the range of 1.4 to 2.5 mm.

* * * * *